United States Patent [19]

Saha et al.

[11] Patent Number: 5,061,586

[45] Date of Patent: Oct. 29, 1991

[54] GLASS COMPOSITE MAGNETIC CARRIER PARTICLES

[75] Inventors: Bijay S. Saha; Thomas A. Jadwin, both of Rochester, N.Y.

[73] Assignee: Eastman Kodak Company, Rochester, N.Y.

[21] Appl. No.: 504,824

[22] Filed: Apr. 5, 1990

[51] Int. Cl.[5] ..... G03G 9/00; G03G 5/00

[52] U.S. Cl. ..... 430/108; 430/137

[58] Field of Search ..... 430/108, 111, 137, 106

[56] References Cited

U.S. PATENT DOCUMENTS

| | | | |
|---|---|---|---|
| 3,053,770 | 9/1962 | Counts . | |
| 3,713,819 | 1/1973 | Hagenbach et al. . | |
| 3,716,630 | 2/1973 | Shirk . | |
| 3,725,283 | 4/1973 | Fenity . | |
| 3,795,617 | 3/1974 | McCabe . | |
| 3,795,618 | 3/1974 | Kasper . | |
| 3,893,935 | 7/1975 | Jadwin et al. . | |
| 3,938,992 | 2/1976 | Jadwin et al. . | |
| 3,941,898 | 3/1976 | Sadamatsu et al. . | |
| 4,076,857 | 2/1978 | Kasper et al. . | |
| 4,124,385 | 11/1978 | O'Horo . | |
| 4,124,735 | 11/1978 | O'Horo et al. | 430/108 |
| 4,126,437 | 11/1978 | O'Horo . | |
| 4,336,173 | 6/1982 | Ugelstad . | |
| 4,341,648 | 7/1982 | Kubo et al. . | |
| 4,394,430 | 7/1983 | Jadwin et al. . | |
| 4,407,721 | 10/1983 | Koike et al. . | |
| 4,459,378 | 7/1984 | Ugelstad . | |
| 4,473,029 | 9/1984 | Fritz et al. . | |
| 4,546,060 | 10/1985 | Miskinis et al. . | |
| 4,764,445 | 8/1988 | Miskinis et al. . | |
| 4,806,265 | 2/1989 | Suzuki et al. . | |
| 4,855,205 | 8/1989 | Saha et al. . | |
| 4,855,206 | 8/1989 | Saha . | |

FOREIGN PATENT DOCUMENTS

| | | |
|---|---|---|
| 1501065 | 2/1978 | United Kingdom . |

*Primary Examiner*—Marion E. McCamish
*Assistant Examiner*—S. Crossan
*Attorney, Agent, or Firm*—Willard G. Montgomery

[57] ABSTRACT

Disclosed are two-phase glass composite carrier particles which comprise a composite of a magnetically hard ferrite material having a single phase hexagonal crystalline structure of the formula $MO.6Fe_2O_3$ where M is barium, strontium or lead exhibiting a coercivity of at least 300 Oersteds when magnetically saturated and an induced magnetic moment of at least 20 EMU/gm when in an applied field of 1000 Oersteds which is dispersed in a glass matrix comprised of from about 10 to 20 molar percent CuO, from about 10 to 40 molar percent BaO and from about 10 to 40 molar percent $B_2O_3$; or a glass matrix comprised of from about 10 to 20 molar percent of $V_2O_5$, from about 10 to 40 molar percent BaO and from about 10 to 40 molar percent $B_2O_3$.

Also disclosed is an electrostatic two-phase dry developer composition comprising charged toner particles mixed with oppositely charged carrier particles as described above.

A method of developing an electrostatic image by contacting the image with the two-phase dry developer composition also is disclosed. The developer compositions of the invention exhibit reduced toner throw-off and other disclosed advantages.

16 Claims, No Drawings

GLASS COMPOSITE MAGNETIC CARRIER PARTICLES

The invention herein relates to the field of electrography and to the development of electrostatic images. More particularly, the present invention relates to novel electrographic developer compositions and components thereof, and to a method of applying such compositions to electrostatic images to effect development thereof.

In electrography, an electrostatic charge image is formed on a dielectric surface, typically the surface of a photoconductive recording element. Development of this image is commonly achieved by contacting it with a two-component developer comprising a mixture of pigmented resinous particles (known as "toner") and magnetically attractable particles (known as "carrier"). The carrier particles serve as sites against which the nonmagnetic toner particles can impinge and thereby acquire a triboelectric charge opposite that of the electrostatic image. During contact between the electrostatic image and the developer mixture, the toner particles are stripped from the carrier particles to which they had formerly adhered (via triboelectric forces) by the relatively strong electrostatic forces associated with the charge image. In this manner, the toner particles are deposited on the electrostatic image to render it visible.

It is known in the art to apply developer compositions of the above type to electrostatic images by means of a magnetic applicator which comprises a cylindrical sleeve of nonmagnetic material having a magnetic core positioned within. The core usually comprises a plurality of parallel magnetic strips which are arranged around the core surface to present alternative north-/south magnetic fields. These fields project radially, through the sleeve, and serve to attract the developer composition to the sleeve's outer surface to form a brush nap. Either or both the cylindrical sleeve and the magnetic core are rotated with respect to each other during use to cause the developer to advance from a supply sump to a position in which it contacts the electrostatic image to be developed. After development, the toner-depleted carrier particles are returned to the sump for toner replenishment.

Conventionally, carrier particles made of soft magnetic materials, e.g., magnetite, pure iron, ferrite or a form of $Fe_3O_4$) having a coercivity, Hc, of about 100 Oersteds when magnetically saturated have been employed to carry and deliver the toner particles to the electrostatic image. U.S. Pat. Nos. 4,546,060 and 4,473,029 teach the use of "hard" magnetic materials as carrier particles and an apparatus for the development of electrostatic images utilizing such hard magnetic carrier particles, respectively. These patents require that the carrier particles comprise a hard magnetic material exhibiting a coercivity of at least 300 Oersteds when magnetically saturated and an induced magnetic moment of at least 20 EMU/gm when in an applied magnetic field of 1000 Oersteds. The terms "hard" and "soft" when referring to magnetic materials have the generally accepted meaning as indicated on page 18 of *Introduction To Magnetic Materials* by B. D. Cullity published by Addison-Wesley Publishing Company, 1972. These hard magnetic carrier materials represent a great advance over the use of soft magnetic carrier materials in that the speed of development is remarkably increased without experiencing deterioration of the image. Speeds as high as four times the maximum speed utilized in the use of soft magnetic carrier particles have been demonstrated.

The above two mentioned U.S. patents, while generic to all hard magnetic materials having the properties set forth, prefer the hard magnetic ferrites which are compounds of barium and/or strontium such as, $BaFe_{12}O_{19}$, $SrFe_{12}O_{19}$ and the magnetic ferrites having the formula $MO.6Fe_2O_3$, where M is barium, strontium or lead as disclosed in U.S. Pat. No. 3,716,630.

While the speed with which development can be carried out with the use such hard magnetic materials as carrier particles is much higher than the speed with which development can be carried out with carrier particles made of soft magnetic particles, these hard magnetic materials exhibit a certain amount of undesirable and deleterious toner throw-off. The term "toner throw-off" as used herein is defined to mean the amount of toner powder thrown out of the developer mix (i.e., carrier plus toner) as it is mechanically agitated, e.g., in the magnetic brush development apparatus. Aside from the extraneous contamination problem inherent in the apparatus, toner throw-off also leads to imaging problems such as unwanted background and scumming of the electrostatic image-bearing element.

Accordingly, it would be highly desirable to be able to provide hard magnetic materials for use as carrier particles such as the aforedescribed barium, strontium and lead ferrites having the formula $MO.6Fe_2O_3$ wherein M is barium, strontium or lead which not only possess the aforedescribed magnetic properties necessary to obtain high quality copies of the original image and for carrying out high speed development, but which in addition exhibit reduced levels of toner throw-off. The present invention provides such carrier particles.

SUMMARY OF THE INVENTION

The present invention provides carrier particles for use in the development of electrostatic images in which the carrier particles are two-phase carrier particles and comprise a composite of a magnetically hard ferrite material having a single phase hexagonal crystalline structure of the formula $MO.6Fe_2O_3$ wherein M is barium, strontium or lead exhibiting a coercivity of at least 300 Oersteds when magnetically saturated and an induced magnetic moment of at least 20 EMU/gm when in an applied field of 1000 Oersteds which is dispersed in a glass matrix comprised of from about 10 to 20 molar percent of CuO, from about 10 to 40 molar percent BaO and from about 10 to 40 molar percent $B_2O_3$ or, alternatively, which is dispersed in a glass matrix comprised of from about 10 to 20 molar percent $V_2O_5$, from about 10 to 40 molar percent BaO and from about 10 to 40 molar percent of $B_2O_3$.

The invention also contemplates an electrographic developer suitable for high speed copying applications without the loss of copy image quality which exhibits reduced toner throw-off including charged toner particles and oppositely charged carrier particles as described above. A method of developing electrostatic images on a surface also is contemplated utilizing the two-component developer compositions of the present invention.

DETAILED DESCRIPTION OF THE INVENTION

As pointed out above in connection with U.S. Pat. Nos. 4,546,060 and 4,473,029, the use of hard magnetic materials as carrier particles increases the speed of development dramatically when compared with carrier particles made of soft magnetic particles. The preferred ferrite materials disclosed in these patents include barium, strontium and lead ferrites having the formula $MO.6Fe_2O_3$ wherein M is barium, strontium or lead. These materials have a hexagonal structure. (The disclosures of these two patents are incorporated herein by reference.) While the speed with which development can be carried out with these materials is much higher than the speed with which development can be carried out using soft magnetic materials, many of these materials exhibit a level or degree of toner throw-off which, if reduced, would not only provide hard magnetic materials capable of increasing the speed with which electrostatic images can be developed over the use of soft magnetic carrier materials, but also hard magnetic materials which also are effective in reducing contamination problems caused by airborne toner dust in the development apparatus along with the additional imaging problems such as unwanted background and scumming of the electrostatic image-bearing elements caused by toner throw-off.

Quite surprisingly, Applicants have found that by dispersing such hard ferrite materials in glass matrices of certain compositions, the amount of toner throw-off exhibited by such hard hexagonal ferrite materials can be reduced without effecting the high magnetic properties of the material. While it is not the intent to be bound by any theory or mechanism by which toner throw-off is thereby reduced, reduced toner throw-off is believed to be due to the following. Typically, the hard ferrite magnetic carrier particles described above are prepared by mixing the oxides or carbonates of the elements in the appropriate portion with an organic binder and water and spray-drying the mixture to form a fine dry particulate. The particulate is then fired at about 1200° C. for a period of time sufficient to produce the ferrite. The ferrite is then magnetized and optionally coated with a polymer, as is well known in the art, to better enable the carrier particles to triboelectrically charge the toner particles. As a result of the spray-drying operation, a certain amount of dry particulate is formed which is of such small size in terms of surface area, that the ferrite carrier particles produced therefrom, after firing, are so small that not enough of the toner particle surface area can contact the surface area of such carrier particles during the time available between which the toner is picked-up from the supply source and the time it contacts the electrostatic latent image, for the toner to become sufficiently triboelectrically charged to produce a strong enough electrostatic force between the carrier particle and the toner particle to prevent the toner particle from being thrown-off of the carrier particle during this time. However, when the same small, fine dry particulate produced by the spray-drying operation discussed above is fired in the presence of a glassy composition of the present invention, this same small particulate which otherwise would produce hard magnetic ferrite carrier particles too small in terms of surface area to triboelectrically charge a toner particle sufficiently enough to create an electrostatic force between the carrier particle and the toner particle (or particles) strong enough to prevent the toner particle from being thrown-off of the carrier particle during development, instead becomes fused or attached to the larger particulate matter formed during the spray-drying operation so that only carrier particles having surface areas large enough to sufficiently charge the toner particles triboelectrically to create an electrostatic force between the carrier particle and the toner particle strong enough to prevent toner throw-off during development (or at least a greater number of such carrier particles) are thereby produced and the unwanted carrier particles which otherwise would be too small to create such an electrostatic force are eliminated or at least substantially reduced. As will be discussed in greater detail below, in the two-phase carrier compositions of the present invention, the hard magnetic ferrite material is dispersed in a glass matrix which is in the form of a thin film or coating, preferably discontinuous, on the surface of the ferrite material so that the ferrite material is essentially or substantially encapsulated in a glass coating or film. Thus, when the particulate matter which ultimately forms the ferrite material of the carrier composition is fired with the glassy compositions of the invention to produce the two-phase glass composite carrier particles of the invention, the glassy coatings or films on the particulate matter of insufficient size melt and fuse to the glass coatings surrounding the larger particulate matter thereby become attached or connected to the larger particulate matter. The net effect is the creation of a narrower particle size distribution of carrier particles having a reduced amount of the unwanted carrier particles.

The carrier compositions of this invention are prepared by first mixing together all of the components in the form of oxide powders in the appropriate proportion and ball milling the mixture with an organic binder such as gum arabic and water as a solvent and spray-drying the mixture, for example, in a Niro spray dryer to remove the solvent and form a fine dry particulate which is then collected. In order to keep the powders well suspended in the aqueous media containing gum arabic, a small amount of a surfactant, such as ammonium polymethacrylate, is typically added to the aqueous media. The resultant beads are then fired at from about 900° C. to about 1200° C., preferably at about 1100° C. for about 5 to 12 hours to form the two-phase composite carrier compositions of the invention. The carrier particles are then deagglomerated and classified by repeated screening to reduce the particle size to that generally required of carrier particles, that is, less than 100 μm and preferably from about 5 to 65 μm and then permanently magnetized by subjecting the particles to an applied magnetic field of sufficient strength to magnetically saturate the particles. The carrier particles so formed may be coated with a polymer, as is well known in the art, to better enable the carrier particles to triboelectrically charge the toner particles. This will be discussed more fully below. The carrier particles can be passed through a sieve to obtain the desired range of sizes. A typical particle sizes, including the polymer coating is about 5 to about 65 micrometers, but smaller carrier particles, about 5 to about 20 micrometers, are preferred as they produce a better image quality.

The ferric oxide and barium, strontium or lead oxide compounds may be added separately or, if desired, these ingredients may be added in the form of $BaO.6Fe_2O_3$, $SrO.6Fe_2O_3$ or $PbO.6Fe_2O_3$. Alternatively, the barium, strontium and lead compounds can be added as barium, strontium or lead carbonate. Where the iron compound is added separately, as distinguished from addition as $BaO.6Fe_2O_3$, $SrO.6Fe_2O_3$ or $PbO.6Fe_2O_3$, it should preferably be incorporated in the batch as the oxide $Fe_2O_3$. However, ferrous nitrate, ferrous carbonate or the like which convert to the oxide on firing may be used if desired though not to the same advantage. It will be understood, of course, that the quantities of the ingredients added to the raw batch should be on the basis of the required amounts of the oxides as indicated above, since any carbonates, etc., will convert to the oxides during firing. It should also be understood that oxides of copper other than cupric oxide, such as cuprous oxide, and oxides of boron and vanadium other than boric oxide and vanadium pentoxide, such as boron pentoxide and vanadium tetraoxide, also can be used in the practice of the present invention. The resultant carrier particle composition is a two-phase composition comprising a magnetically hard ferrite material having a single phase hexagonal crystalline structure of the formula $MO.6Fe_2O_3$ where M is barium, strontium or lead which exhibits a coercivity of at least 300 Oersteds when magnetically saturated and an induced magnetic moment of at least 20 EMU/gm when in an applied field of 1000 Oersted dispersed in a glass matrix which is in the form of a thin film or coating, preferably discontinuous, on the surface of the hard ferrite material so that spots of bare ferrite on each particle provide conductive contact and the ferrite material is essentially or substantially encapsulated by the glass coating or film.

It has been found generally that the amount of the glass matrix not exceed approximately 20 percent by weight of the total weight of the carrier composite as concentrations in excess of this amount tend to adversely effect or decrease the induced magnetic moment of the carrier particle which creates image quality problems. Thus, amounts of from about 1.0 to about 20 percent by weight of glass based on the total weight of the carrier is preferred. By using such a comparatively low concentration of glass forming oxides in the preparation of the carrier composition, the glassy matrix forms a thin, discontinuous layer or coating on the ferrite particles. This allows the mass of particles to remain conductive and serves to insure that the necessary magnetic properties of the ferrite component of the carrier composition for carrying out the development method are maintained. It is equally important that the $Fe_2O_3$ to MO molar ratio of 6 to 1 should be maintained close, with no more than a three percent excess of either of these materials since any substantial deviation from the specified ratio leads to a substantial reduction in magnetic strength.

The coercivity of a magnetic material refers to the minimum external magnetic force necessary to reduce the induced magnetic moment, M, from the remanence value, Br, to zero while it is held stationary in the external field, and after the material has been magnetically saturated, i.e., the material has been permanently magnetized. A variety of apparatus and methods for the measurement of coercivity of the present carrier particles can be employed. For the present invention, a Princeton Applied Research Model 155 Vibrating Sample Magnetometer, available from Princeton Applied Research Co., Princeton, N.J., was used to measure the coercivity of powder particle samples. The powder was mixed with a nonmagnetic polymer powder (90 percent magnetic powder: 10 percent polymer by weight). The mixture was placed in a capillary tube, heated above the melting point of the polymer, and then allowed to cool to room temperature. The filled capillary tube was then placed in the sample holder of the magnetometer and a magnetic hysteresis loop of external field (in Oersteds) versus induced magnetism (in EMU/gm) was plotted. During this measurement, the sample was exposed to an external field of 0 to 9000 Oersteds.

The carriers in the developers of the present invention contain magnetic material which exhibits a coercivity of at least 300 Oersteds when magnetically saturated, preferably a coercivity of at least 500 Oersteds and most preferably a coercivity of at least 1000 Oersteds. In this regard, while magnetic materials having coercivity levels of 1300 to 3000 have been found useful, it is not advantageous that coercivity levels exceed approximately 3000 Oersteds because it has been found that magnetically hard ferrite materials having coercivities in excess of approximately 3000 Oersteds interfere with the carrier flow on the magnetic brush.

In addition to the minimum coercivity requirements of the magnetic material, the carrier particles in the developers of this invention exhibit an induced magnetic moment, M, of at least 20 EMU/gm, based on the weight of the carrier. Preferably, M at 1000 Oersteds for the present carriers is at least 25 EMU/gm, and most preferably is from about 30 to about 50 EMU/gm. In this regard, carrier particles with induced fields of from 50 to 100 EMU/gm also are useful.

A preferred composition for the two-phase carrier composite consists of about 78% by weight $Fe_2O_3$, 13% by weight BaO and 9% by weight of glassy material comprising 10 molar percent CuO, 10 molar percent BaO and 80 molar percent of $B_2O_3$. The following additional examples will serve to illustrate the compositions comprehended by the invention:

81% by weight $Fe_2O_3$, 9% by weight SrO, 10% by weight of a glassy composition comprising 10 molar percent CuO, 10 molar percent BaO and 80 molar percent $B_2O_3$;

74% by weight $Fe_2O_3$, 18% by weight PbO, 8% by weight of a glassy composition comprising 10 molar percent CuO, 10 molar percent BaO and 80 molar percent $B_2O_3$.

The induced moment of composite carriers in a 1000 Oersteds applied field is dependent on the concentration of magnetic material in the particle. It will be appreciated, therefore, that the induced moment of the magnetic material should be sufficiently greater than 20 EMU/gm to compensate for the effect upon such induced moment from dilution of the magnetic material in the glass matrix. For example, one might find that, for a concentration of 50 weight percent magnetic material in the composite particles, the 1000 Oersteds induced magnetic moment of the magnetic material should be at least 40 EMU/gm to achieve the minimum level of 20 EMU/gm for the composite particles.

The glassy material used with the finely divided magnetic material is selected to provide the required mechanical and electrical properties. It should (1) adhere well to the magnetic material, (2) facilitate formation of strong, smooth-surfaced particles and (3) preferably possess sufficient difference in triboelectric properties from the toner particles with which it will be used to insure the proper polarity and magnitude of electrostatic charge between the toner and carrier when the two are mixed.

As mentioned previously, carrier particles of the invention are employed in combination with toner particles to form a dry, two-component composition. In use, the toner particles are electrostatically attracted to the electrostatic charge pattern on an element while the carrier particles remain on the applicator shell or sleeve. This is accomplished in part by intermixing the toner and carrier particles so that the carrier particles acquire a charge of one polarity and the toner particles acquire a charge of the opposite polarity. The charge polarity on the carrier is such that it will not be electrically attracted to the electrostatic charge pattern. The carrier particles also are prevented from depositing on the electrostatic charge pattern because the magnetic attraction exerted between the rotating core and the carrier particles exceeds the electrostatic attraction which may arise between the carrier particles and the charge image.

Tribocharging of toner and hard magnetic carrier is achieved by selecting materials that are so positioned in the triboelectric series to give the desired polarity and magnitude of charge when the toner and carrier particles intermix. If the carrier particles do not charge as desired with the toner employed, moreover, the carrier can be coated with a material which does. Such coating can be applied as described herein. The charging level in the toner is preferably at least 5 μcoul per gram of toner weight. The polarity of the toner charge, moreover, can be either positive or negative.

Various resin materials can be employed as a coating on the two-phase composite carrier particles of the invention. Examples include those described in U.S. Pat. Nos. 3,795,617 issued Mar. 5, 1974, to J. McCabe; 3,795,618 issued Mar. 5, 1974, to G. Kasper; and 4,076,857 to G. Kasper. The choice of resin will depend upon its triboelectric relationship with the intended toner. For use with toners which are desired to be positively charged, preferred resins for the carrier coating include fluorocarbon polymers such as poly(tetrafluoroethylene), poly(vinylidene fluoride) and poly(vinylidene fluoride-co-tetrafluoroethylene).

The carrier particles can be coated with a tribocharging resin by a variety of techniques such as solvent coating, spray application, plating, tumbling or melt coating. In melt coating, a dry mixture of carrier particles with a small amount of powdered resin, e.g., 0.05 to 5.0 weight percent resin is formed, and the mixture heated to fuse the resin. Such a low concentration of resin will form a thin or discontinuous layer of resin on the carrier particles so that the mass of particles remains conductive.

The developer is formed by mixing the particles with toner particles in a suitable concentration. Within developers of the invention, high concentrations of toner can be employed. Accordingly, the present developer preferably contains from about 70 to 99 weight percent carrier and about 30 to 1 weight percent toner based on the total weight of the developer; most preferably, such concentration is from about 75 to 99 weight percent carrier and from about 25 to 1 weight percent toner.

The toner component of the invention can be a powdered resin which is optionally colored. It normally is prepared by compounding a resin with a colorant, i.e., a dye or pigment, and any other desired addenda. If a developed image of low opacity is desired, no colorant need be added. Normally, however, a colorant is included and it can, in principle, be any of the materials mentioned in *Colour Index*, Vols. I and II, 2nd Edition. Carbon black is especially useful. The amount of colorant can vary over a wide range, e.g., from 3 to 20 weight percent of the polymer. Combinations of colorants may be used.

The mixture is heated and milled to disperse the colorant and other addenda in the resin. The mass is cooled, crushed into lumps and finely ground. The resulting toner particles range in diameter from 0.5 to 25 micrometers with an average size of 1 to 16 micrometers. Preferably, the average particle size ratio of carrier to toner lie within the range from about 15:1 to about 1:1. However, carrier-to-toner average particle size ratios of as high as 50:1 are also useful.

The toner resin can be selected from a wide variety of materials, including both natural and synthetic resins and modified natural resins, as disclosed, for example, in the patent to Kasper et al, U.S. Pat. No. 4,076,857 issued Feb. 28, 1978. Especially useful are the crosslinked polymers disclosed in the patent to Jadwin et al, U.S. Pat. No. 3,938,992 issued Feb. 17, 1976, and the patent to Sadamatsu et al, U.S. Pat. No. 3,941,898 issued Mar. 2, 1976. The crosslinked or noncrosslinked copolymers of styrene or lower alkyl styrenes with acrylic monomers such as alkyl acrylates or methacrylates are particularly useful. Also useful are condensation polymers such as polyesters.

The shape of the toner can be irregular, as in the case of ground toners, or spherical. Spherical particles are obtained by spray-drying a solution of the toner resin in a solvent. Alternatively, spherical particles can be prepared by the polymer bead swelling technique disclosed in European Pat. No. 3905 published Sept. 5, 1979, to J. Ugelstad.

The toner can also contain minor components such as charge control agents and antiblocking agents. Especially useful charge control agents are disclosed in U.S. Pat. No. 3,893,935 and British Pat. No. 1,501,065. Quaternary ammonium salt charge agents as disclosed in *Research Disclosure*, No. 21030, Volume 210, October, 1981 (published by Industrial Opportunities Ltd., Homewell, Havant, Hampshire, PO9 1EF, United Kingdom), are also useful.

The carriers employed in the present invention invariably exhibit a high remanence, $B_R$. As a result, carriers made up of these materials, behave like wet sand because of the magnetic attraction exerted between carrier particles. Replenishment of the present developer with fresh toner, therefore, presents some difficulty. Developer replenishment is enhanced when the toner is selected so that its charge, as defined below, is at least 5 microcoulombs per gram of toner. Charging levels from about 10 to 30 microcoulombs per gram toner are preferred, while charging levels up to about 150 microcoulombs per gram of toner are also useful. At such charging levels, the electrostatic force of attraction between toner particles and carrier particles is sufficient to disrupt the magnetic attractive forces between carrier particles, thus facilitating replenishment. How these charging levels are achieved is described below.

The charge on the toner, Q/M, in microcoulombs/gram, is measured using a standard procedure in which the toner and carrier are placed on a horizontal electrode beneath a second horizontal electrode and are subjected to both an AC magnetic field and a DC electric field. When the toner jumps to the other electrode change in the electric charge is measured and is divided by the weight of toner that jumped. It will be appreciated, in this regard, that the carrier will bear about the same charge as, but opposite in polarity to, that of the toner.

In the method of the present invention, an electrostatic image is brought into contact with a magnetic applicator which comprises a cylindrical sleeve of nonmagnetic material having a magnetic core positioned within and the two-component, dry developer described above. Preferably, the magnetic applicator or brush comprises a rotating-magnetic core having an outer nonmagnetic sleeve which may or may not also rotate, either in the same direction as or in a different direction from the core. The electrostatic image so developed can be formed by a number of methods such as by imagewise photodecay of a photoreceptor, or imagewise application of a charge pattern on the surface of a dielectric recording element. When photoreceptors are employed, such as in high-speed electrophotographic copy devices, the use of halftone screening to modify an electrostatic image is particularly desirable, the combination of screening with development in accordance with the method of the present invention producing high-quality images exhibiting high Dmax and excellent tonal range. Representative screening methods including those employing photoreceptors with integral halftone screens are disclosed in U.S. Pat. No. 4,385,823 issued May 31, 1984, in the names of G. E. Kasper et al.

The invention is further illustrated by the following examples.

EXAMPLE 1

A two-phase carrier composition of the invention was prepared as follows.

Powders of strontium carbonate (49.21 grams), iron oxide (302.88 grams) and 33.74 grams of a glass composition consisting of 10 molar percent cuprous oxide, 10 molar percent barium oxide and 80 molar percent boric oxide were mixed thoroughly. In a separate container, a stock solution was prepared by dissolving 4.0 weight percent (based on the weight of the solution) of a binder resin, i.e., gum arabic and 0.033 weight percent ammonium polymethacrylate surfactant (sold by W. R. Grace and Co. as "Daxad-32") in distilled water. The powders were mixed with the stock solution in a 50:50 weight ratio, and the mixture was ball milled for about 24 hours and then spray dried in a Niro spray dryer. The green bead particles thus formed were classified to obtain a suitable particle size distribution. The green bead was then fired at a temperature of approximately 1100° C. for 10 hours. X-ray diffraction revealed a two-phase composition with only the unreacted glass as the second phase. The saturation magnetism and the coercivity of the ferrite were 46.1 EMU/gm and 1300 Oersted, respectively.

EXAMPLE 2

A two-phase carrier composition was prepared exactly as described in Example 1, except that the glass containing the green bead was fired at approximately 1000° C. for 10 hours. The saturation magnetic moment remained unchanged, but coercivity increased to 2955 Oersteds.

EXAMPLE 3

A two-phase carrier composition was prepared exactly as described in Example 1, except that the glass containing the green bead was fired at approximately 900° C. for 10 hours. The saturation magnetic moment remained unchanged, but the coercivity increased to 2544 Oersteds.

EXAMPLE 4

This example compares the development charge of the two-phase glass composite magnetic carrier compositions of Examples 1 to 3 with a single phase hard magnetic strontium ferrite carrier material as a control having a hexagonal crystal structure and a saturation magnetic moment of approximately 55 EMU/gm and a coercivity of approximately 1800 Oersteds obtained commercially from Powder Tech. Inc., Valpariso, Ind. which was not dispersed in a glass composition of the present invention. The development charge is the charge deposited on a photoconductive element by the developer during development. The higher is the development charge, the greater is the number of copies that can be made per unit time. The toner used was a standard black styrene butyl acrylate toner (Example 1 of U.S. Pat. No. 4,394,430) at a concentration of 10% by weight, based on total carrier place toner weight. A linear xerographic device was used, and a D.C. bias was applied to the magnetic brush. During development, the charge on the photoconductive element was measured at different biases. The brush speed was 1000 rpm and the film speed was 25.4 centimeters per second.

| Magnetic Brush | Development Charge ($\times 10^{-7}$ μcoulomb) | | | |
|---|---|---|---|---|
| Bias (volts) | Control | Example 1 | Example 2 | Example 3 |
| 25 | 0.8 | 0.46 | 0.48 | 0.56 |
| 50 | 1.4 | 0.93 | 0.95 | 1.07 |
| 75 | 2.14 | 1.41 | 1.46 | 1.65 |
| 100 | 2.62 | 1.87 | 1.93 | 2.2 |
| 125 | 3.45 | 2.63 | 2.55 | 2.93 |
| 150 | 4.04 | 2.81 | 3.00 | 3.47 |

The above table shows that the two-phase glass composite magnetic carriers of the present invention had a development charge at a given bias substantially comparable to those of the control.

EXAMPLE 5

In this example, the charge was measured on the styrene butyl acrylate toner used in Example 4 at 10% by weight, based on total carrier plus toner weight. (The charge on the toner, Q/M, in microcoulombs/gram, is measured using a standard procedure in which the toner and carrier are placed on a horizontal electrode beneath a second horizontal electrode and are subjected to both an AC magnetic field and a DC electric field. When the toner jumps to the other electrode, the change in the electric charge is measured and is divided by the weight of toner that jumped). The following table compares the charge on the toner 30 seconds after initiation of the AC magnetic field using the control carrier and the three carriers from Examples 1, 2 and 3.

| | Q/M 30 sec. |
|---|---|
| Control | 41.1 |
| Example 1 | 31.4 |
| Example 2 | 33.8 |
| Example 3 | 34.1 |

The above table shows that the charging characteristics of the two-phase glass composite carriers of the invention are substantially comparable to those of the control.

EXAMPLE 6

In this example, the throw-off was measured using the styrene butyl acrylate toner used in Example 4 at 10% by weight, based on the total carrier plus toner weight. The throw-off is a measurement of the strength of the electrostatic bond between the toner and the carrier. A magnetic brush loaded with developer is rotated and the amount of toner that is thrown off the carrier is measured. A device employing a developer station as described in U.S. Pat. No. 4,473,029 and a Buckner funnel disposed over the magnetic brush at 0 bias such that the filter paper is in the same relative position as the photoreceptor was used to determine throw-off of toner during rotation of the brush. The brush is rotated for each carrier for two minutes while vacuum is drawn and toner is collected on the filter paper. The following table compares the throw-off of the toner when the control carrier was used and when the three carriers prepared in Examples 1, 2 and 3 were used.

| | Throw-Off (Mg) |
|---|---|
| Control | 1.9 |
| Example 1 | 0 |
| Example 2 | 0 |
| Example 3 | 0.8 |

The data establishes that while the charge on the toner in each case is substantially the same, the throw-off is significantly higher when the control carrier is used as compared to the novel carriers of the invention.

Barium ferrite and lead ferrite containing glass composite compositions achieve similar results when used as electrographic carrier materials.

The invention has been described in detail with particular reference to preferred embodiments thereof, but it will be understood that variations and modifications can be effected within the spirit and scope of the invention.

We claim:

1. Two-phase carrier particles for use in the development of electrostatic latent images which comprise hard magnetic ferrite materials having a single phase hexagonal crystalline structure of the formula $MO.6Fe_2O_3$ where M is barium, strontium or lead exhibiting a coercivity of at least 300 Oersteds when magnetically saturated and an induced magnetic moment of at least 20 EMU/gm of carrier in an applied field of 1000 Oersteds dispersed in a glass matrix comprised of from about 10 to 20 molar percent CuO, from about 10 to 40 molar percent BaO and from about 10 to 40 molar percent $B_2O_3$, or a glass matrix comprised of from about 10 to 20 molar percent $V_2O_5$, from about 10 to 40 molar percent BaO and from about 10 to 40 molar percent $B_2O_3$.

2. The carrier particles of claim 1 wherein the hard magnetic ferrite material is strontium ferrite.

3. The carrier particles of claim 1 wherein the hard magnetic ferrite material is barium ferrite.

4. The carrier particles of claim 1 wherein the hard magnetic ferrite material is lead ferrite.

5. The carrier particles of claim 1 wherein the glass matrix is present in an amount of from about 1 to 20 percent by weight based on the total weight of the carrier particle.

6. The carrier particles of claim 1 wherein the coercivity of the magnetic material is from 300 to about 3000 Oersteds and the induced magnetic moment of the carrier particles is from 20 EMU/gm to about 50 EMU/gm.

7. A method of developing an electrostatic latent image comprising contacting the image with a two-component dry developer composition comprising charged toner particles and oppositely charged carrier particles according to claim 1.

8. A method of claim 7 wherein the charge of said toner is at least 5 microcoulombs per gram of toner.

9. An electrostatic two-component dry developer composition for use in the development of electrostatic latent images which comprises a mixture of charged toner particles and oppositely charged two-phase carrier particles which comprise hard magnetic ferrite material having a single phase hexagonal crystalline structure of the formula $MO.6Fe_2O_3$ where M is barium, strontium or lead exhibiting a coercivity of at least 300 Oersteds when magnetically saturated and an induced magnetic moment of at least 20 EMU/gm of carrier in an applied field of 1000 Oersteds dispersed in a glass matrix comprised of from about 10 to 20 molar percent CuO, from about 10 to 40 molar percent BaO and from about 10 to 40 molar percent $B_2O_3$, or a glass matrix comprised of from about 10 to 20 molar percent $V_2O_5$, from about 10 to 40 molar percent BaO and from about 10 to 40 molar percent $B_2O_3$.

10. The composition of claim 9 wherein the hard magnetic ferrite material is strontium ferrite.

11. The composition of claim 9 wherein the hard magnetic ferrite material is barium ferrite.

12. A composition of claim 9 wherein the hard magnetic ferrite material is lead ferrite.

13. The composition of claim 9 wherein the glass matrix is present in an amount of from about 1 to 20 percent by weight based on the total weight of the carrier particle.

14. The composition of claim 9 wherein the coercivity of the magnetic material is from 300 to about 3000 Oersteds and the induced magnetic moment of the carrier particles is from 20 EMU/gm to about 50 EMU/gm.

15. The composition of claim 9 wherein the charge of said toner is at least 5 microcoulombs per gram of toner.

16. A method of developing an electrostatic latent image comprising contacting the image with a two-component dry developer composition according to claim 9.

* * * * *